US008919360B1

(12) United States Patent
Ransley

(10) Patent No.: US 8,919,360 B1
(45) Date of Patent: Dec. 30, 2014

(54) CABINET WASHER AND RACK SYSTEM

(71) Applicant: Gilbert Frank Ransley, McFarland, WI (US)

(72) Inventor: Gilbert Frank Ransley, McFarland, WI (US)

( * ) Notice: Subject to any disclaimer, the term of this patent is extended or adjusted under 35 U.S.C. 154(b) by 0 days.

(21) Appl. No.: 14/177,290

(22) Filed: Feb. 11, 2014

Related U.S. Application Data

(60) Provisional application No. 61/823,181, filed on May 14, 2013.

(51) Int. Cl.
*B08B 3/02* (2006.01)
*A47L 15/42* (2006.01)
*A47L 15/50* (2006.01)

(52) U.S. Cl.
CPC ..... *A47L 15/4246* (2013.01); *A47L 15/507* (2013.01)
USPC ..... 134/198

(58) Field of Classification Search
USPC ..... 134/198
See application file for complete search history.

(56) References Cited

U.S. PATENT DOCUMENTS 3,098,465 A * 7/1963 Lvey ..... 119/417
3,163,149 A * 12/1964 Ivey ..... 119/479
4,732,172 A * 3/1988 Pedersen ..... 134/62
4,741,351 A 5/1988 Minkin
5,640,981 A 6/1997 Niemela et al.
5,722,443 A 3/1998 Marler et al.
6,044,852 A 4/2000 Epperson, Jr. et al.
6,055,996 A * 5/2000 Sprenger et al. ..... 134/133
6,109,277 A 8/2000 Linton et al.
8,297,291 B1 10/2012 Bluestone et al.

OTHER PUBLICATIONS

Alvey Washing Equipment, A Division of Cincinnati Industrial Machinery, www.alveywashing.com, brochure, Model KS-48.
Alvey Washing Equipment, Division of Cincinnati Industrial Machinery, www.alveywashing.com, brochure, Model KS-70.
Alvey Washing Equipment, A Division of Cincinnati Industrial Machinery, www.alveywashing.com, brochure, Model KS-88.
Sani-Matic, sanimatic.com, brochure, "Tacticab".
Sani-Matic, sanimatic.com, brochure, "Sanicab".
Sani-Matic, sanimatic.com, brochure, "Product Carrier Washers".

* cited by examiner

*Primary Examiner* — Michael Barr
*Assistant Examiner* — Jason Riggleman
(74) *Attorney, Agent, or Firm* — Stiennon & Stiennon

(57) ABSTRACT

A cabinet washer is supported on legs above a floor. Fluid dispensing heads discharge wash fluid within the cabinet. A sump collects wash fluid leaving the cabinet, for recirculation as desired through a pump. A wheeled cart has a frame which supports a tray and a rack above the wheels. Items to be washed are positioned on the rack and the cart is received within the cabinet, at which point the bottom wall of the tray underlies the cabinet bottom wall opening. The tray bottom wall slopes to receive fluid discharged within the cabinet interior compartment and convey it through a cabinet rear wall opening. The sump may be provided with a deflector which alternately sends fluid to be recirculated or drained from the sump. The front door may be hinged to the cabinet, or may be mounted to the cart itself.

20 Claims, 5 Drawing Sheets

CABINET WASHER AND RACK SYSTEM

CROSS REFERENCES TO RELATED APPLICATIONS

This application claims the benefit of priority of U.S. provisional app. No. 61/823,181, filed May 14, 2013, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to devices for treating elements with fluid within an enclosed cabinet.

Cabinet style washers are used in commercial and industrial applications to clean equipment and products in batches. Typically the parts to be cleaned will be loaded on a rack of a cart exterior to the cabinet, and then brought into the cabinet for cleaning. Because the cleaning fluid, which can be costly, is recirculated throughout the cleaning cycle, fluid will be collected and recirculated from a sump which is located beneath the level of the rack, thus requiring that the sump be recessed into the floor, or that the rack travel by ramp or lift to the level of the cabinet. If a sump is to be located at or above floor level in such a system, a suction pump is required to bring the liquid from its point of collection to the sump. Ramps, lifts, and sumps add cost to the installation. Moreover, ramps and lifts require additional space and hence add cost. In addition extra safety precautions must be taken when working with ramps and lifts to avoid inherent hazards. Recessed sumps can flood causing damage to nearby electrical equipment. Another approach uses nested carts comprising a first wheeled cart which is releasably mounted to an underlying second wheeled cart. The assembly is then brought adjacent to a cabinet washer with an elevated wash chamber, and the first cart is then rolled into and out of the wash chamber.

What is needed is a fluid treatment assembly which permits for the convenient treatment of cart mounted elements while obviating the need for a below grade sump, ramp, lift, or multiple nested carts.

SUMMARY OF THE INVENTION

A cabinet washer of this invention has a cabinet that extends upwardly from a floor, and which has side walls having a front opening, and a bottom wall with a bottom opening. Fluid dispensing heads within the cabinet are connected to a pump which recirculates wash fluid collected in a sump which collects wash fluid discharged from the cabinet. A wheeled cart has a frame which supports a tray and a rack above the wheels. A front door is positionable to close the front opening when the cart is received within the cabinet, at which point the bottom wall of the tray underlies the cabinet bottom wall opening. The tray bottom wall communicates with the sump, and is sloped so as to receive fluid discharged within the cabinet interior compartment and to convey the fluid through an opening in a rear wall of the cabinet to the sump. The sump may be provided with a deflector which alternately sends fluid to be recirculated or drained from the sump. The front door may be hinged to the cabinet, or may be mounted to the cart itself, such that when the cart is inserted within the cabinet, the door is sealed against the cabinet front wall.

It is an object of the present invention to provide a cabinet washer which mounts flush with a building floor and which receives the items to be washed on a wheeled cart.

It is a further object of the present invention to provide a cabinet washer which allows items to be washed without being removed from a transporting cart.

Further objects, features and advantages of the invention will be apparent from the following detailed description when taken in conjunction with the accompanying drawings.

DESCRIPTION OF THE PREFERRED EMBODIMENTS

Figure 1:
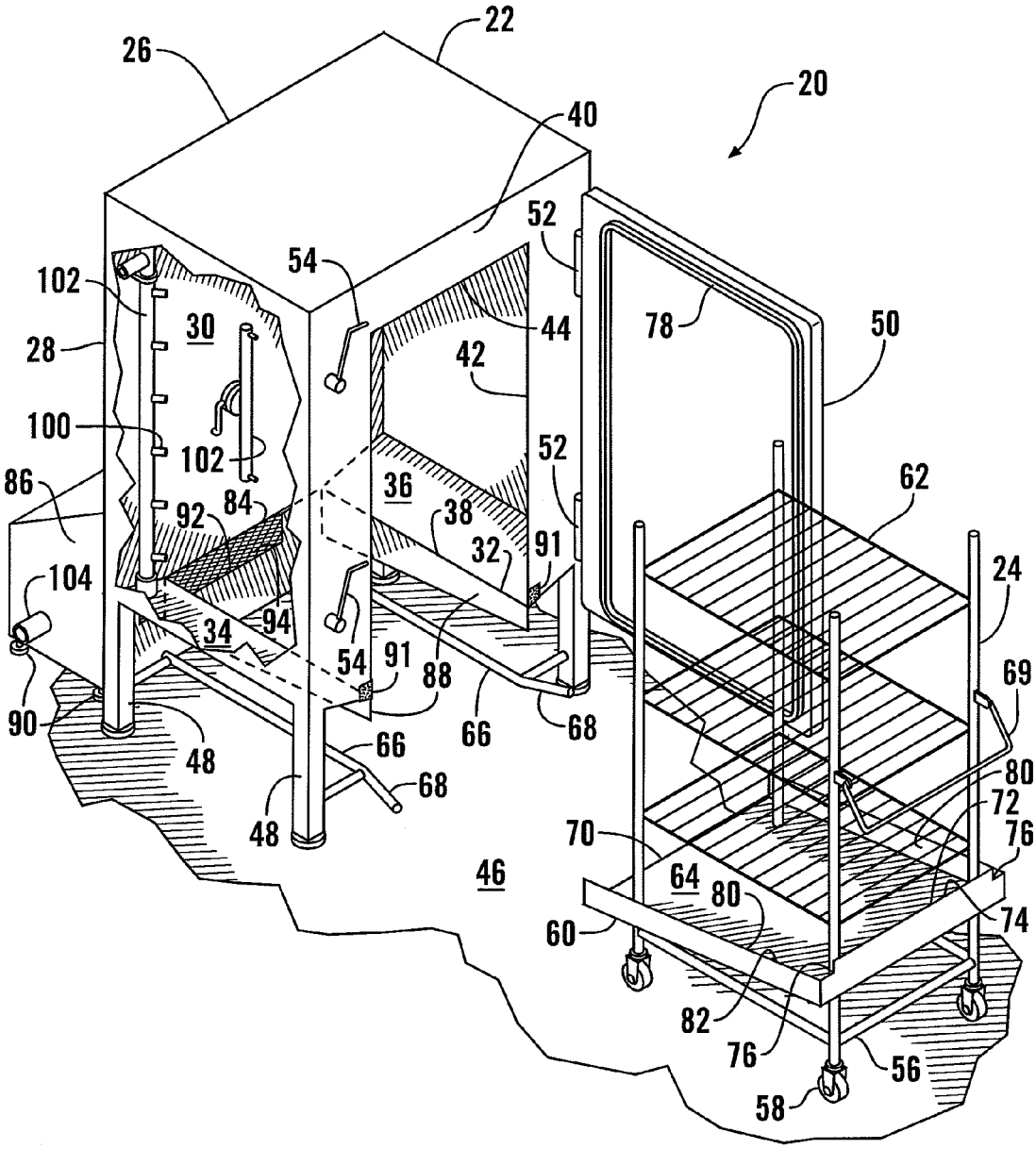
FIG. 1 is an isometric view, partially broken away in section, of a cabinet washer and rack cart assembly of this invention, with the rack cart shown prior to insertion within the cabinet.

Referring more particularly to FIGS. 1-7, wherein like numbers refer to similar parts, a cabinet washer assembly 20 is shown in FIG. 1. The assembly has a cabinet 22 which receives a wheeled cart 24 having articles supported thereon which it is desired to clean. Process fluid 106 such as cleaning solution, sodium hydroxide mixed with water, rinse water, etc., is introduced into the cabinet for treatment of the articles carried on the cart 24.

The cabinet 22 has a top wall 26 with downwardly extending side walls 28 including a rear wall 30. A bottom wall 32 is defined by a left pan 34 and a right pan 36 which slope from opposite side walls 28 to a bottom opening 38. A front wall 40 extends between the opposed side walls 28 and has a front opening 42 through which the cart 24 gains admittance to an interior compartment 44 defined within the cabinet 22. The cabinet 22 may be fabricated of stainless steel or other durable corrosion resistant materials. The cabinet 22 is supported above a floor 46 on level-adjustable legs 48. A front door 50 is pivotally mounted to the front wall 40 on hinges 52. The door is pivotable to clear the front opening 42, and may be pivoted to close on the front wall 40 and block the opening. The door 50 is held in a closed position by two door cam latches 54.

The cart 24 has a frame 56 to which four adjustable casters 58 are mounted. A tray 60 is mounted to the frame 56 above the casters 58. The front casters may be swivel casters, while the rear may be fixed. A support structure such as a rack 62 is mounted to the frame 56 to extend upwardly from the tray 60.

The rack 62 supports the various elements or parts which it is desired to clean within the cabinet 22. The cart 24 is freely movable on the wheels of the casters 58 from a second position exterior to the cabinet, where the rack 62 is loaded with the items to be cleaned, and a first position, shown in FIG. 2, in which the rack 62 and its contents are received within the cabinet. The cart 24 rides on the casters, which directly engage the floor, to move in a first direction towards the cabinet. The cabinet 22 may be provided with two rack guide members 66, each mounted between two cabinet legs 48. The guide members 66 are rods which have angled segments 68 which extend frontwardly of the cabinet front wall 40 and which engage the cart frame to guide the cart 24 into engagement with the cabinet until the frame is entirely received within the cabinet interior compartment. A handle 69 is mounted to the front of the cart frame 56, and may be extended for pulling the cart out of the cabinet, or folded down against the frame when the cart is received within the cabinet, as shown in FIG. 2.

As shown in FIG. 1, the cart tray 60 may be formed of sheet metal, such as stainless steel, and has a bottom wall 64 which is inclined in the first direction away from the front of the cart. The inclined bottom wall 64 extends rearwardly to a rear perimeter 70. A front lip 72 extends upwardly from the bottom wall, and has a central segment 74 which extends upwardly somewhat from the two side segments 76 of the front lip. The front door 50 has an inside seal 78 which engages against the central segment 74 of the tray front lip 72 when it is closed on the cabinet. The seal 78 may be a compressible rubber gasket, or an inflatable elastomeric seal. Two side lips 80 extend upwardly from the sides of the tray bottom wall 64. The lips 80 are parallel, and extend rearwardly from the side segments 76 of the front lip 72. Each lip has an upper perimeter 82 which is parallel to the tray bottom wall 64, and thus is inclined downwardly towards the rear of the tray 60.

Figure 2:
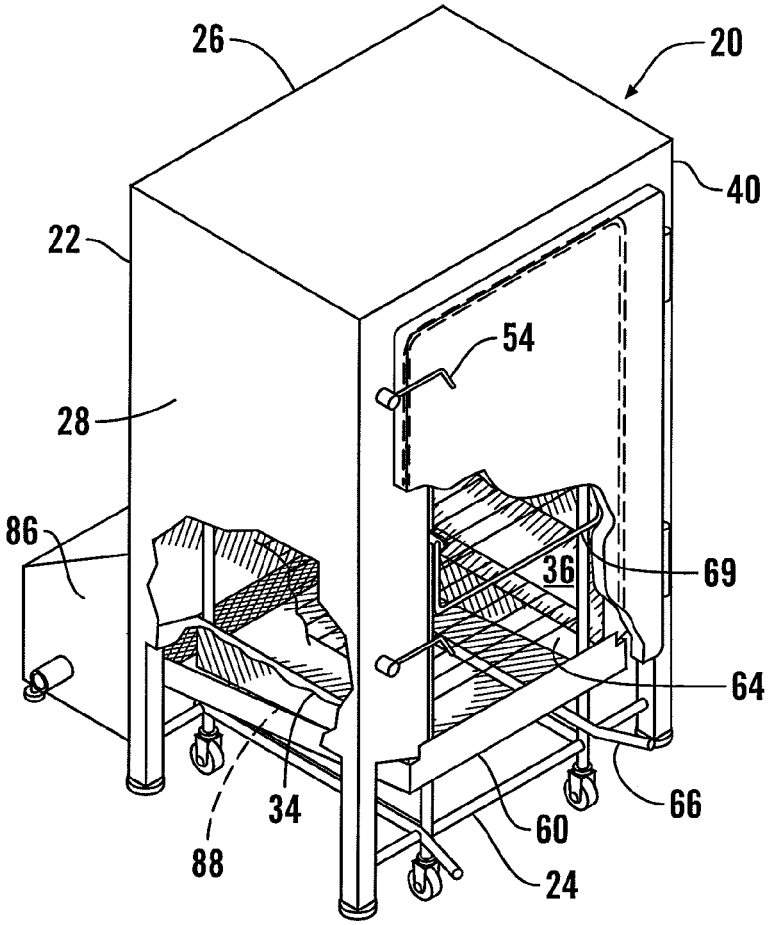
FIG. 2 is an isometric view, partially broken away in section, of the apparatus of FIG. 1 with the rack cart received within the cabinet.
Figure 3:
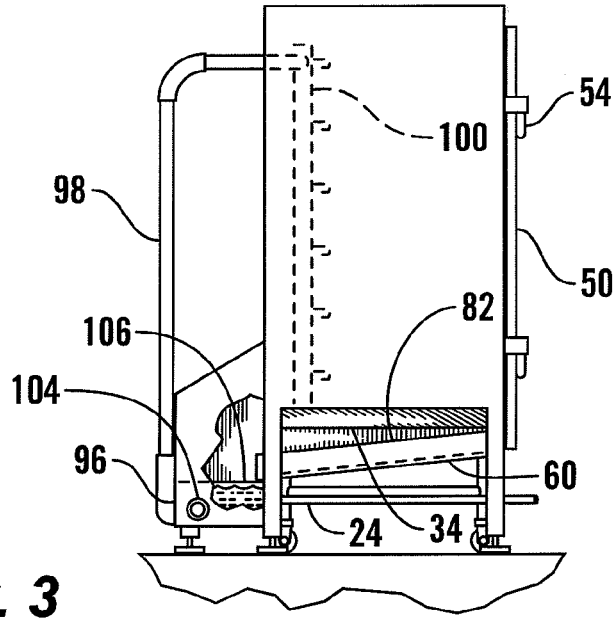
FIG. 3 is a side elevational view, partially broken away in section of the apparatus of FIG. 1.

As best shown in FIGS. 2 and 3, when the cart 24 is received within the cabinet 22, the tray bottom wall 64 protrudes beneath the lower edge 84 of the cabinet rear wall 30 to extend over a fluid receptacle or sump 86. The tray side lips 80 then extend to the outside of two downwardly extending bottom pan lips 88 which extend from the left pan 34 and the right pan 36 on either side of the bottom opening 38. Because the bottom pans 34, 36 have a single slope, the height of the bottom pan lips is greater at the rear of the cabinet than at the front. With the cart tray side lips 80 on either side of the bottom pan lips 88, the bottom wall 64 of the tray underlies the cabinet bottom opening so that fluid draining from the cabinet is captured on the tray 60 and discharged into the sump 86. Although there is not a liquid tight seal between the cart and the cabinet, a limited amount of leakage is acceptable. The central segment 74 of the front lip 72 of the cart 24 overlaps the front wall of the cabinet by 1-2 inches on either side of the front opening. Preferably shallow indents are formed in the cabinet front wall 40 on each side of the front opening 42, which receive elastomeric gaskets 91. The outer surfaces of the gaskets 91 are engaged by the lower portion of the front door 50 when it is closed on the cabinet allowing a face seal on the door perimeter across and between the cabinet front surface and the cart tray lip 72 front face.

As shown in FIG. 3, the sump 86 is an upwardly opening box supported on height adjustable feet 90 rearwardly of the cabinet 22. Portions of the sump 86 may be received underneath the cabinet 22 to give a greater extent of overhang of the cart tray bottom wall 64 over the top opening 92 of the sump. A screen 94 is positioned within the sump 86 beneath the top opening 92 and beneath the rear perimeter 70 of the overlying cart tray bottom wall 64, such that larger elements in the fluid discharged from the cabinet can be prevented from recirculation. The sump 86 communicates with a pump 96 which is connected via a conduit 98 to a fluid discharge opening 100 in a spray device 102 within the cabinet interior. An exemplary spray device is illustrated in FIG. 1, but any type of spray device may be used, such as a spray ball, a spray nozzle, an array of spray nozzles on a vertical pipe which is rotated by a gear motor or pneumatic cylinder, or a spinner with nozzles on the end of radially extending conduits which are rotated by water pressure or other means. A drain 104 is provided in the side of the sump 86 which permits wash fluid to be drained from the sump as needed, or replaced with rinse fluid. The sump is supplied with the fresh fluid from the outside through fill conduits which are not shown.

In use the cart is first loaded with the items to be treated within the assembly 20, for example utensils and flatware, manufactured parts prior to painting or coating, process equipment, etc. The loaded cart 24 is then pushed along the floor into the cabinet 22 until it is fully received within the interior compartment. The front handle 69 is then folded down and the front door 50 is closed over the front wall opening 42, bringing the seal 78 into engagement with the front wall 40 and the front lip 72 of the cart. The front lip 72 then engages the gaskets 91 on the front wall 40. Some leakage is acceptable at this juncture, or a cuplike extension of the cart may be provided as discussed below with respect to FIG. 7. The door cam latches 54 are secured to hold the cart 24 securely within the cabinet 22. The assembly 20 may be provided with a safety switch, not shown, which prevents operation when the front door is not closed, as well as a safety switch the prevents operation when the rack is not fully or properly received within the cabinet. With the cart 24 received within the cabinet 22, the cart tray bottom wall 64 extends beneath the rear wall 30 of the cabinet over the sump 86. The pump 96 is then engaged to discharge the fluid from the sump 86 into the interior compartment 44. The fluid may be changed at designated times, such as to rinse off the cleaning fluid. Then, when the cleaning cycle is complete, the pump is deactivated 96 and all liquid is allowed to drain along the cart tray bottom wall 64 into the sump 86. The front door 50 is then opened, and the cart 24 is removed from the cabinet 22 and transported to a place of final disposition of the treated elements.

Figure 4:
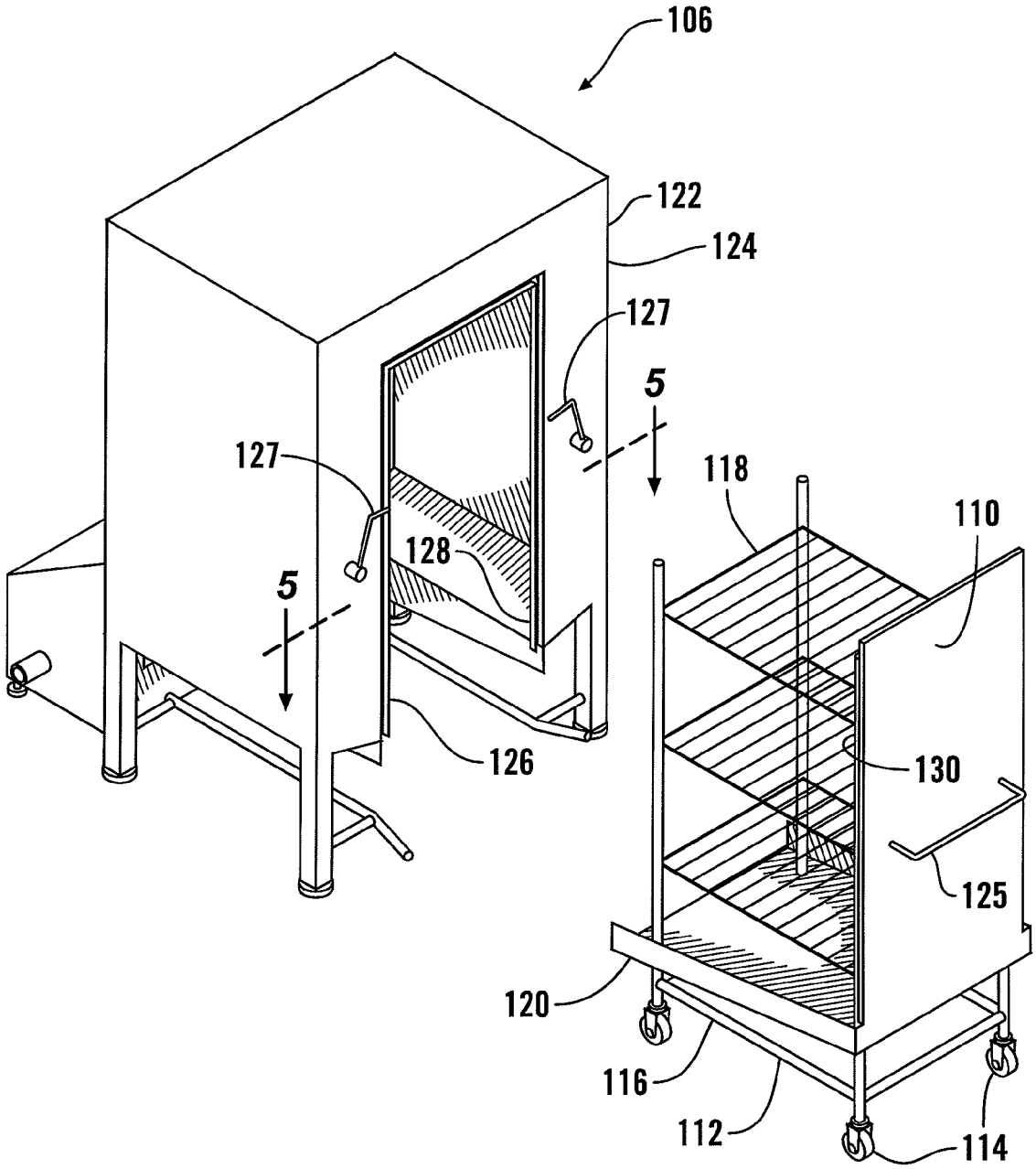
FIG. 4 is an isometric view of an alternative embodiment of a cabinet washer and rack cart assembly of this invention, with the rack cart shown prior to insertion within the cabinet.
Figure 5:
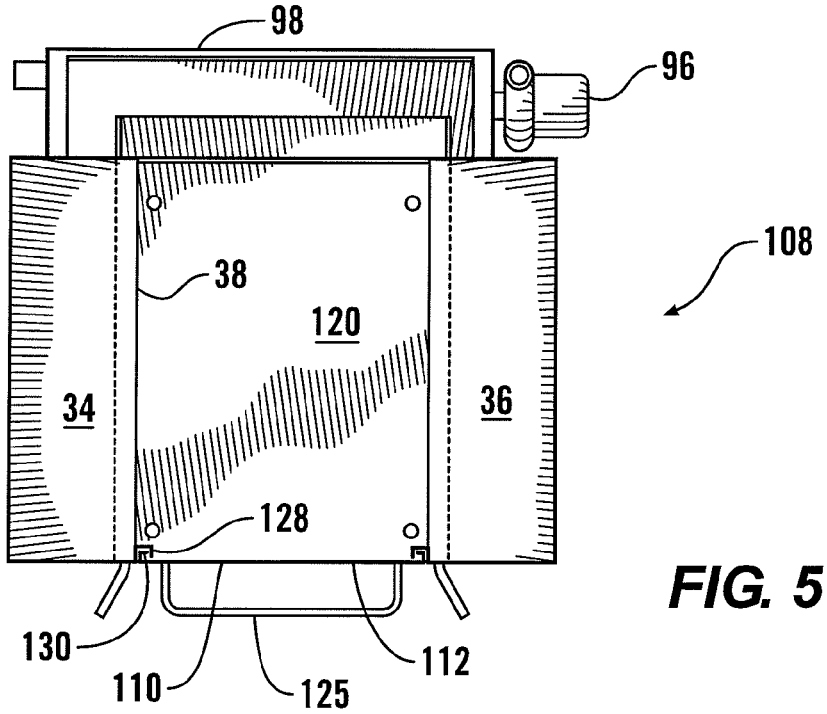
FIG. 5 is a cross-sectional view of the apparatus of FIG. 4 taken along section line 5-5.

An alternative embodiment assembly 108 is shown in FIGS. 4 and 5, in which the front door 110 is fixed directly to the cart 112. The cart 112 has casters 114, a frame 116, and a rack 118 similar to the ones described above, but the front door 110 is mounted to the frame 116 and extends upwardly from the tray 120 mounted beneath the rack 118. The cabinet 122 has a front wall 124 with a front opening which has a perimeter 126 which has a sheet metal angled piece 128, shown in FIG. 5, which engages with a mating angled piece 130 of sheet metal on the top and sides of the front door 110, such that a labyrinth seal is formed when the cart is received within the cabinet. The front door 110 has a handle 125, which, because it does not need to fit inside the cabinet, need not be foldable. The cart 112 front door 110 is held securely in place on the cabinet by cam latches 127 mounted to the cabinet 122 on each side of the front door.

Figure 6:
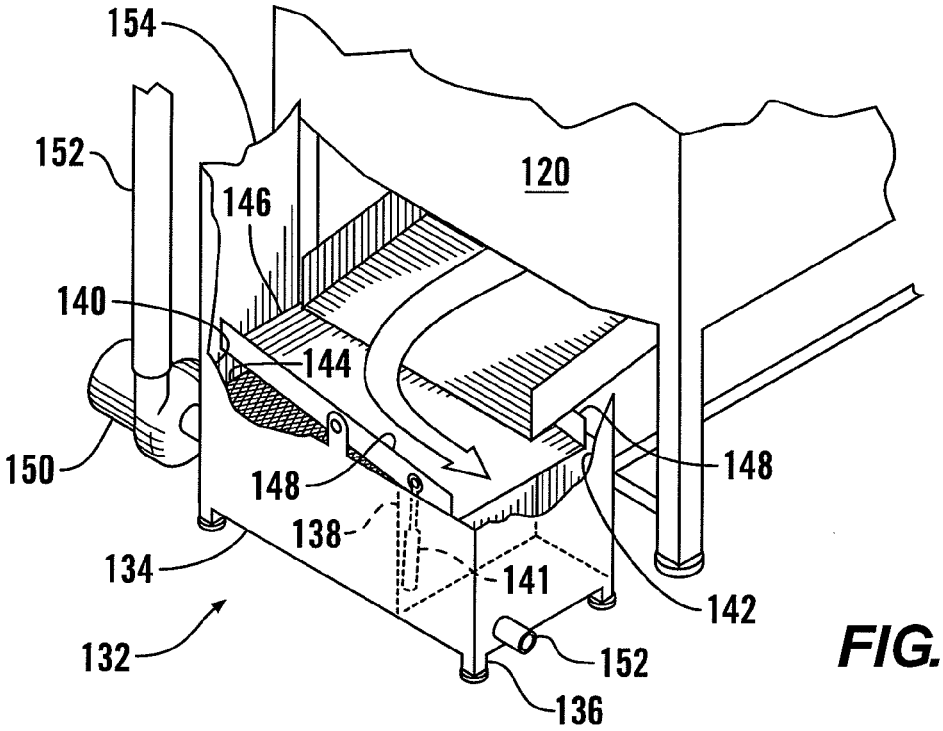
FIG. 6 is a rear isometric view, partially broken away in section, of a sump arrangement for use with the cabinet washer and rack cart assembly of this invention.

An alternative embodiment sump assembly 132 is shown in FIG. 6 which may be employed with the cabinets and racks described above. The sump assembly 132 has a housing 134 mounted on adjustable legs 136 which is divided by a dividing wall 138 into a process liquid or wash solution chamber 140 and a drain chamber 142. The wash solution chamber is covered by a filter screen 144 while the drain chamber 142 need not have a screen. The wash solution chamber 140 communicates with a pump 150, and the drain chamber 142 communicates with a drain pipe 152.

A divert plate 146 is pivotally mounted to the housing 134, and has upwardly extending parallel front and back lips 148. The divert plate 146 extends beneath the cart tray 60, and receives all of the liquid that flows from the cabinet on the tray 60. An actuator 141 may extend between the divert plate 146 and the housing 134, and may be operated to tilt the divert plate to one side or the other. The divert plate 146 can be adjusted between a first position, in which the divert plate is inclined towards the process liquid chamber 140 to direct the flow of liquid into the process liquid chamber for recirculation by the pump, and a second position in which the divert plate is inclined towards the drain chamber to direct the flow of liquid into the drain chamber for discharge of the liquid from the fluid receptacle. The side walls 154 of the housing 134 extend above the levels of liquid within the housing to serve as a splash guard to restrict fluid escaping from the open housing.

Figure 7:
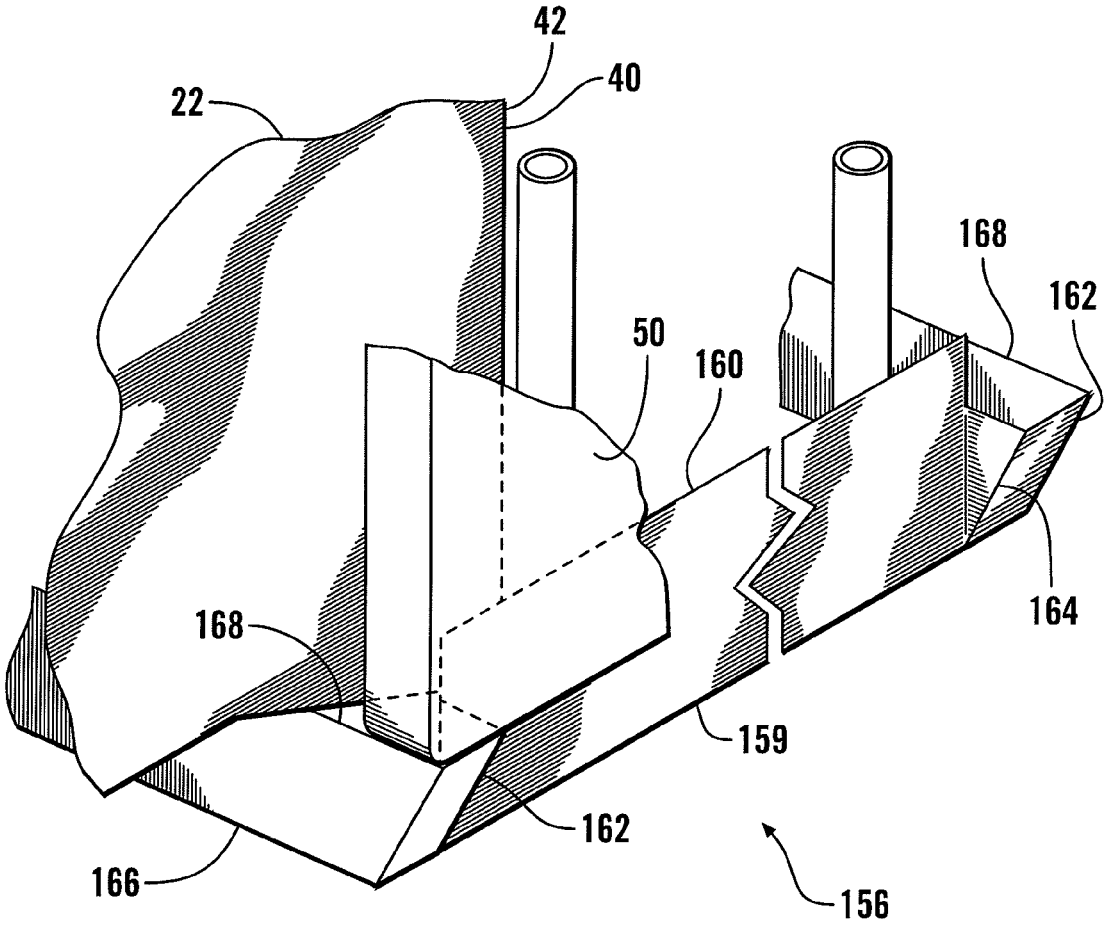
FIG. 7 is a fragmentary isometric view of an alternative embodiment cart and tray arrangement to be used with the cabinet of FIG. 1.

An alternative embodiment cart 156 and tray 158 is shown in FIG. 7, which can be used with the cabinet 22 having a hinged door 50. The tray 158 has a front lip 159 with a central segment 160 which extends vertically to overlie the front wall 40 on either side of the front opening 42. The side segments 162 of the front lip are angled frontwardly from the central segment 160, and are joined by intermediate segments 164 to the central segment, and on the sides are connected to the side lips 166 to define cups 168 which project frontwardly the thickness of the door 50. The cups 168 are thus positioned to collect liquid which drips downwardly from the corners of the door 50.

It should be noted that the support structure may include a rack with multiple levels as illustrated, or, in a special case may be integrated with the cart tray to support an element to be cleaned directly on the tray.

It is understood that the invention is not limited to the particular construction and arrangement of parts herein illustrated and described, but embraces all such modified forms thereof as come within the scope of the following claims.

I claim:

1. A fluid discharge apparatus for mounting above a floor, comprising:

a cabinet having upwardly extending side walls, and portions defining a front wall with a front opening and a bottom opening between the side walls which opens to the floor, the cabinet defining an interior compartment wherein fluid may be discharged onto compartment contents;

a cart having a frame;

wheels mounted to the frame for engagement with the floor;

a support structure mounted to the frame, wherein the cart is freely movable on the floor between a first position in which the support structure is received within the cabinet, and a second position in which the cart is exterior to the cabinet; and portions of the cart which define a tray mounted above the wheels, the tray having a bottom wall which underlies the cabinet bottom opening when the cart is in the first position thereby serving as a bottom wall of the cabinet, the tray bottom wall being thereby interposed between the cabinet bottom opening and the floor to capture fluid discharged onto compartment contents, the tray bottom wall communicating with a region beneath the tray, and positioned to receive fluid discharged within the cabinet interior compartment which passes through the cabinet bottom opening and to direct said received fluid to said region beneath the tray; and a front door positionable to close the front opening when the cart is in the first position.

2. The apparatus of claim 1 further comprising:

a fluid receptacle disposed exterior to the cabinet interior compartment to receive the fluid discharged from the cart tray, and connected via a conduit to a fluid discharge opening within the cabinet interior compartment; and a pump between the fluid receptacle and the conduit, operable to recirculate fluid through the cabinet interior compartment.

3. The apparatus of claim 2 wherein the fluid receptacle comprises an upwardly opening container, and wherein an intermediate dividing wall extends upwardly to divide the container into a process liquid chamber communicating with the pump and a drain chamber communicating with a drain, and further comprising:

a divert plate pivotally mounted to the container above the process liquid chamber and the drain chamber to receive a flow of liquid discharged from the cabinet interior compartment along the cart tray, the position of the divert plate being adjustable from a first position, in which the divert plate is inclined towards the process liquid chamber to direct the flow of liquid into the process liquid chamber for recirculation by the pump, and a second position in which the divert plate is inclined towards the drain chamber to direct the flow of liquid into the drain chamber for discharge of the liquid from the fluid receptacle.

4. The apparatus of claim 1 wherein the front door is hinged to the cabinet front wall.

5. The apparatus of claim 1 wherein the front door is fixed to the cart to extend upwardly from the tray and to close the front opening when the cart is received within the cabinet in the first position.

6. The apparatus of claim 5 wherein the front opening has a perimeter which engages with the door on the cart to define a labyrinthine seal.

7. The apparatus of claim 1 wherein the tray on the cart has two opposed side lips which extend upwardly from the tray bottom wall.

8. The apparatus of claim 7 wherein the cabinet bottom opening is defined between portions of the cabinet defining a left pan and a right pan, and wherein the left and right pans each have a downwardly extending lip, and wherein in the first position the tray side lips are positioned exteriorly to the cabinet left and right pan lips.

9. The apparatus of claim 1 wherein the cart extends from a front to a rear in the direction of travel of the cart from the second position to the first position, and wherein the tray bottom wall is inclined downwardly from a position nearer the front to a rear perimeter of the tray bottom wall.

10. The apparatus of claim 9 wherein one of the cabinet side walls comprises a rear wall which defines a lower opening which communicates between the cabinet interior and a region exterior to the cabinet interior, and wherein when the cart is in the first position received within the cabinet interior with the front door closed on the cabinet, the cart tray bottom wall extends through the cabinet rear wall lower opening to the rear of the cabinet.

11. A fluid treatment apparatus for mounting above a floor, comprising:

a cabinet having a front wall spaced a first distance from a rear wall, the front and rear walls being joined by side walls, the cabinet having an interior compartment defined between the front, rear, and side walls, and wherein portions of the front wall define a front opening, and having left and right side pans on opposite sides of a bottom opening;

a front door positionable to close the front opening;

a fluid receptacle positioned rearwardly of the cabinet rear wall and opening upwardly;

a cart having a frame and a support structure which extends upwardly therefrom, the cart being movable between a first position in which the support structure is received within the cabinet, and a second position in which the cart is exterior to the cabinet; and a tray mounted to the frame spaced above the floor, wherein the cart tray has a bottom wall which underlies the cabinet bottom opening when the cart is in the first position, thereby serving as a bottom wall of the cabinet, the tray bottom wall being thereby interposed between the cabinet bottom opening and the floor to capture fluid discharged within the cabinet interior compartment, wherein the cart tray in the first position extends rearwardly of the cabinet rear wall to overlie portions of the fluid receptacle and is positioned to receive fluid discharged within the cabinet interior compartment which passes through the cabinet bottom opening and to direct said received fluid to the fluid receptacle.

12. The apparatus of claim 11 wherein the cart tray in the first position extends from the front door to a rear perimeter a second distance which is greater than the first distance.

13. The apparatus of claim 11 wherein the fluid receptacle is connected via a conduit to a fluid discharge opening within the cabinet interior compartment, and further comprising:

a pump between the fluid receptacle and the conduit, operable to recirculate fluid through the cabinet interior compartment.

14. The apparatus of claim 13 wherein the fluid receptacle comprises an upwardly opening container, and wherein an intermediate dividing wall extends upwardly to divide the container into a process liquid chamber communicating with the pump and a drain chamber communicating with a drain, and further comprising:

a divert plate pivotally mounted to the container above the process liquid chamber and the drain chamber to receive a flow of liquid discharged from the cabinet interior compartment along the cart tray, the position of the divert plate being adjustable from a first position, in which the divert plate is inclined towards the process liquid chamber to direct the flow of liquid into the process liquid chamber for recirculation by the pump, and a second position in which the divert plate is inclined towards the drain chamber to direct the flow of liquid into the drain chamber for discharge of the liquid from the fluid receptacle.

15. The apparatus of claim 11 wherein the front door is hinged to the cabinet front wall.

16. The apparatus of claim 11 wherein the front door is fixed to the cart to extend upwardly from the tray and to close the front opening when the cart is received within the cabinet in the first position.

17. The apparatus of claim 16 wherein the front opening has a perimeter which engages with the door on the cart to define a labyrinthine seal.

18. The apparatus of claim 11 wherein the tray on the cart has two opposed side lips which extend upwardly from the tray bottom wall, and wherein the cabinet left and right pans each have a downwardly extending lip, and wherein in the first position the tray side lips are positioned exteriorly to the cabinet left and right pan lips.

19. The apparatus of claim 11 wherein the cart extends from a front to a rear in the direction of travel of the cart from the second position to the first position, and wherein the tray bottom wall is inclined downwardly from a position nearer the front to a rear perimeter of the tray bottom wall.

20. A cabinet washer comprising:

a cabinet having a front wall and a rear wall, the front and rear walls being joined by side walls, the cabinet having an interior compartment defined between the front, rear, and side walls, and wherein portions of the front wall define a front opening, and having left and right side pans on opposite sides of a bottom opening;

a front door positionable to close the front opening;

a fluid receptacle exterior to the cabinet interior and opening upwardly;

at least one nozzle positioned within the cabinet interior compartment;

a pump connected between the fluid receptacle and the nozzle, to circulate cleaning fluid within the fluid receptacle through the cabinet interior;

a wheeled cart having a frame and a support structure which extends upwardly therefrom, the cart being movable between a first position in which the support structure is received within the cabinet, and a second position in which the cart is exterior to the cabinet; and a tray mounted to the frame beneath the support structure, wherein the cart tray has a bottom wall which underlies the cabinet bottom opening when the cart is in the first position, thereby serving as a bottom wall of the cabinet to capture fluid discharged from the nozzle within the cabinet interior compartment, wherein the cart tray in the first position extends rearwardly of the cabinet rear wall to overlie portions of the fluid receptacle and is positioned to receive cleaning fluid discharged from the nozzle within the cabinet interior compartment which passes through the cabinet bottom opening and to direct said received fluid to the fluid receptacle.

* * * * *